United States Patent [19]

Jason et al.

[11] Patent Number: 4,917,413

[45] Date of Patent: Apr. 17, 1990

[54] RESILIENT LATCHING DEVICE

[75] Inventors: Donald M. Jason; James A. Jason, both of Asbury, N.J.

[73] Assignee: Donald M. Jason, Asburg, N.J.

[21] Appl. No.: 60,933

[22] Filed: Jun. 9, 1987

Related U.S. Application Data

[63] Continuation-in-part of Ser. No. 852,086, Apr. 14, 1986, abandoned, which is a continuation-in-part of Ser. No. 764,111, Aug. 8, 1985, abandoned, which is a continuation-in-part of Ser. No. 480,832, Mar. 31, 1983, abandoned.

[51] Int. Cl.[4] ..... E05C 19/06

[52] U.S. Cl. ..... 292/76; 292/87; 292/DIG. 38; 292/DIG. 53

[58] Field of Search ..... 292/DIG. 38, 88, 87, 292/89, DIG. 63, 76, 80, 16, 77, 70, 14, 17, DIG. 53

[56] References Cited

U.S. PATENT DOCUMENTS

| | | | |
|---|---|---|---|
| 46,697 | 3/1865 | Plumer | 292/87 X |
| 333,405 | 12/1885 | Gard | 292/76 |
| 815,638 | 3/1906 | Sandberg | 292/76 |
| 1,346,566 | 7/1920 | Stamm . | |
| 1,746,307 | 2/1930 | Frank | 292/76 |
| 1,890,275 | 12/1932 | Wirth . | |
| 1,918,924 | 7/1933 | O'Heir | 292/76 X |
| 1,937,942 | 12/1933 | Briggs . | |
| 2,006,747 | 7/1935 | Ritz-Woller . | |
| 2,328,757 | 7/1943 | Tinnerman . | |
| 2,506,846 | 5/1950 | Teasdale . | |
| 2,709,290 | 5/1955 | Rosenthal | 292/DIG. 38 X |
| 2,895,199 | 7/1959 | Jones | 292/DIG. 38 X |
| 3,038,747 | 6/1962 | Rapata | 292/DIG. 38 X |
| 3,208,780 | 9/1965 | Waller et al. | 292/70 |
| 3,276,167 | 10/1966 | Bus et al. . | |
| 3,466,075 | 9/1969 | Fernandez et al. . | |
| 3,481,076 | 12/1969 | Bedard | 292/144 X |
| 3,544,146 | 12/1970 | Asenbauer | 292/87 |
| 3,630,558 | 12/1971 | Andreini et al. | 292/DIG. 38 X |
| 3,724,889 | 4/1974 | Dooley | 292/DIG. 38 X |
| 3,797,870 | 3/1974 | Beckman | 292/DIG. 38 X |
| 3,841,674 | 10/1974 | Bisbing et al. | 292/DIG. 38 X |
| 3,883,927 | 5/1975 | Francis | 292/87 X |
| 3,909,888 | 10/1975 | Funston et al. | 292/DIG. 38 X |
| 3,954,201 | 5/1976 | Ostrowsky | 292/DIG. 38 X |
| 3,971,241 | 7/1976 | Parsson | 292/144 X |
| 4,145,771 | 3/1979 | Khazin | 292/DIG. 38 X |
| 4,223,787 | 9/1980 | Lowry | 292/DIG. 38 X |
| 4,322,914 | 4/1982 | McGaughey | 292/DIG. 38 X |
| 4,378,948 | 4/1983 | Chrones | 292/DIG. 38 X |
| 4,680,836 | 7/1987 | Wisecup | 24/150 FP |

FOREIGN PATENT DOCUMENTS

| | | | |
|---|---|---|---|
| 1114404 | 9/1961 | Fed. Rep. of Germany | 292/DIG. 38 |
| 2122289 | 11/1971 | Fed. Rep. of Germany . | |
| 789659 | 6/1960 | France | 292/76 |
| 104037 | 3/1942 | Sweden | 292/87 |
| 116929 | 7/1946 | Sweden | 292/87 |
| 16814 | of 1893 | United Kingdom | 292/76 |
| 620988 | 4/1949 | United Kingdom | 292/87 |
| 1117044 | 6/1968 | United Kingdom | 292/76 |

*Primary Examiner*—Lloyd A. Gall

*Attorney, Agent, or Firm*—Martha G. Pugh

[57] ABSTRACT

One-piece latches or door-retenting devices of elastomeric material of specified parameters, are constructed for disposition in the surface of a door or other supporting panel so that at least one lip projects outwardly from the edge or surface in elastically deformable relation to engage a striker bar or surface. A first type includes and elongated lip projecting or depending from one edge, the inner surface of the lip forming a slot which just accommodates the striker bar upon closure of the latch, the adjacent outer surface of the lip projecting in angular relation to the slot providing resilient latching action against the striker bar when the latch is opened or closed. Latch shapes of this type include "D" shape, "C" shape, round, square, polygonal and line configurations. A second type comprises a bellows-like latching member closed at one end with a protuberance in the form of an elastomeric bulb which is constructed to be elastically deformed by the striker bar or latching surface. Such a latch can be readily molded as an intergral part into a panel or container. Additional modifications include a shallow groove surrounding the body of the latch which is constructed to seat around the edge of an opening which has been cut in the closure accommodating the latch. These modified forms include tab latches having a single and a double lip, and knob latches including a round latch symmetrical about an axis through its center.

45 Claims, 12 Drawing Sheets

RESILIENT LATCHING DEVICE

This application is a continuation-in-part of U.S. patent application Ser. No. 852,086 now abandoned, filed Apr. 14, 1986, which is a continuation-in-part of U.S. application Ser. No. 764,111, now abandoned, filed Aug. 8, 1985, which is a continuation-in-part of U.S. patent application Ser. No. 480, 832, filed Mar. 31, 1983, now abandoned.

This relates in general to latching devices more particularly to latches and door retention devices designed to releasably secure doors or panels in closed position against a stationary striker surface, subject to reopening upon the application of a controlled pull force.

BACKGROUND OF THE INVENTION

Latches assume many different forms in the prior art. The most common types are of metal comprising several different elements, including a metal frame which is screwed adjacent to the edge of a movable door panel, and which supports a spring-biased metal tongue which engages either a slot or a projecting member on a striker surface. The prior art includes numerous variations of this basic type, most of which include a plurality of parts, usually formed of metal or some other rigid material, which are expensive to manufacture and install initially, and to replace. Moreover, it is difficult to find suitable prior art latches which are designed to close securely, but which are responsive to a uniform pull force to open.

SHORT DESCRIPTION OF THE INVENTION

It is therefore an object of the present invention to provide various types of simple one-piece resilient latches and/or door retention devices, which are cheaply and easily molded in a preselected shape, and are easily installed and replaced without tools of any kind. Other objects of the inventions are to provide latches which require precisely-controlled pull forces, and which are characterized by long life causing a minimum amount of wear on their contact surfaces, and on the striker surfaces against which they operate.

These and other objects of the invention are realized in a one-piece latch formed of elastomeric or elastoplastic material having typical specified parameters, such as durometer hardness, tensile strength, percentage elongation, tear strength, having a protuberance which is constructed to engage a striker bar or contacting surface in elastically deformable relation. One type of latch in accordance with the pesent invention comprises one or more lips forming catches which are precisely angled to provide a slot which elastically accommodates and bears against the engaging surface. The material may comprise, for example, an elastomer such as a natural or synthetic rubber or an elastoplastic material characterized by the following typical parameters:

a durometer hardness within the range of between about 20 and 100 on the Shore A scale, and 0 and 100 on Shore D Scale; a percentage elongation of at least about 125; and a tensile strength of at least about 550 pounds per square inch (38 Kg/cm.). Other desirable parameters are set forth in tabular form in the detailed description hereinafter.

The material should also be resistant to deterioration by exposure to ozone and water vapor.

In an embodiment of a first type, the latch of the present invention may comprise a closed body configuration having the major surface of the body lying in parallel planes slightly spaced-apart by the thickness, and means to secure the latch to a door or panel. In other embodiments, this open center is closed with a thin sheet adjacent to the base or inwardly-directed major surface of the latch. In some other embodiments, a knob protrudes from one of the outer major surfaces of the latch. In still other embodiments, the latch takes the form of a strip having an elongated catch forming lip which extends along its length.

A particular feature of the latch or door retention device of our invention of the type described in the foregoing paragraph is its cross-sectional shape which may include a peripheral notch of uniform width and depth at least partially surrounding the edge of the body portion, which notch is just wide and deep enough to snap into and accommodate the edges of an opening cut into the door or of a panel in or on which it is installed. That portion of the latch which is constructed to contact the edge of a striker bar or plate takes the form of a downwardly and outwardly protruding lip forming a catch. This comprises an inside surface which depends or protrudes in a direction normal to the base surface of the latch body, terminating at its lower or outer end in a sharp edge or thin rectangular land in a plane parallel to the base, which edge is constructed to contact and rest momentarily against the strike surface as the latch is being closed. The projecting edge may form an angle of from zero to 90 degrees in a cross-sectional plane with the undercut edge of the catch. The function of the outwardly angled lip forming the catch is to provide cam-action against the striker bar or panel. Thus, in response to a thrust against the latch, squeezing it inwardly, it is compressed in a direction parallel to the surface, so that the catch snaps into place against the striker bar or plate when the door is closed; and in response to a pull directed against the cam surface, upon opening the door, the striker bar or panel is pushed out of the catch. Whenever in the specification and claims hereinafter the words "striker bar" are used, it will be understood that this includes any plate or panel against which the catch of the latch of the present invention is designed to engage in closed relation. In some embodiments, this requires a bar or plate superposed over the door or panel surface in which the latch is installed; whereas in other embodiments the latch is designed to close against the door or panel surface without an additional striker bar or plate being interposed.

It is contemplated that the latch or door retention device of the present invention of the type described in the foregoing paragraphs may be formed in numerous different shapes or sizes. For example, it may take the form of a "D", open at the center and having the lip forming a catch protruding along the straight edge. An opening is cut in the door or panel, the edges of which are shaped to accommodate the peripheral notch of the D-shaped latch in snap-in relation, preferably without the use of any bonding or securing means. The latch may alternatively be formed in the shape of a "C" with the catch at the back of the "C"; or it may be formed in the shape of a complete or flattened circle with the catch portion along one edge, or on diametrically opposite edges or completely around the periphery. The latch may take the form of a rectangle with the catch on one or opposite edges, or of a polygon having any number of sides with the catch along one or more, or all of the edges. All of these shapes may have the centers closed, or open, as desired, and may or may not be formed to include handles. A unique modification of the latch of the present invention may take the form of a strip which may be cut to any desired length and disposed to provide an extended catch along the edge of a door or panel.

Another type of latch in accordance with the present invention is of a different shape than those described in the foregoing paragraphs, but nevertheless embodies the same principal of being constructed to sustain elastic deformation as it contacts and snaps into frictional engagement against a striker bar or surface. This comprises a bellows-like latch body the cylindrical surface of which is striated, and having a protuberance or lip at one end which projects out symmetrically about the long axis of the body. In one form, the latch member may comprise a hollow or solid elastic body of overall cylindrical form, having a series of parallel peripheral grooves around its sidewall, and terminating at the closed end in a semi-spherical bulb or button constructed to engage a striker bar which may either be flat, or comprise a matching dimple which accommodates the semi-spherical bulb.

In one embodiment, the latter member may be seated in a cylindrical rectangular housing formed at the edge of a door so that the semi-spherical bulb or button projects outward in a direction normal to the panel edge. The striker bar may comprise a metal surface having a semi-spherical depression at the center in which the semi-spherical bulb is elastically engaged when the door snaps shut, closing the latch.

In another embodiment, the latch member is housed in a holder comprising a cylindrical cavity having a large circular opening in the top through which the elastic bulb or button projects, and a smaller circular opening at the bottom. A pair of ears bent outwardly from opposite sides of the holder enable the holder to be fastened in place at the edge of a door.

In other embodiments, the latch member may have a small or non-existent body portion, the outwardly-projecting bulb or button being surrounded by a lateral rim or annular flange in the manner of a hat, which flange may be broad or narrow, and which may or may not have holes symmetrically-spaced surrounding the central bulb or button to permit the latch to be fastened in place near the edge of a door. In one embodiment a groove surrounding the bulb or button on the inside of the rim provides fastening means.

In each of these cases the striker bar would comprise a flat surface of metal or other rigid material, or a dimple centered to accommodate the deformable bulb or button.

In accordance with further improved forms of the present invention, in order to facilitate nesting of the latch in a hole or slot cut in a closure or supporting panel, a lateral groove is cut around the periphery of the latch body, which is constructed to seat on the edge of the hole or slot. The specific forms include a tab latch formed with an integrally formed ring which extends laterally from the inside edge of the latch body, which may be grasped and pulled up to disengage the latch, and one or two undercut latching lips.

In another modification, a knob latch including a catch protruding from one edge, has been formed with a nesting groove surrounding the latch body to facilitate installation in a slot in the supporting surface.

Another form comprises a round latch having an annular nesting groove and an annular protruding catch which surround the grasping knob co-axially.

Particular advantages of the latches or door retention devices of the present invention are their simplicity and cheapness of manufacture and installation. A particular feature of these types of latches is that they may be injection-molded or extruded by mass production techniques. The latch portion comprises only a single part which may be molded to any desired shape and quickly snapped into place or removed from the supporting surface without the use of any screws, bolts, or bonding materials, or without the need of tools for installation and removal.

The latches of the present invention are designed to release in response to a pre-determined pull force. They can be designed to accommodate pull requirements of between as little as one ounce and many pounds. Wear and tear on the latches by the striker bar or plate against which the latches operate is minimized as they have high tensile strength and high tear strength; and if wear occurs in the catch portion of the latch, the latch can be quickly and easily replaced. Moreover, in certain of the embodiments, the latch can be formed to include additional catch members on a plurality of sides or an annular catch, as in the case of the circular valve, so that when the latch wears on one catch or in one position, it is merely necessary to rotate it and reseat it in the latch site with a fresh portion of the catch in place.

Other advantages of the latches or door retention devices of the present invention are that they are non-corrosive, are resistant to chemical attack and surface degradation, resistant to exposure to ozone, weathering and aging. They are electrically insulating, non-conductive, and exhibit high dielectric strength. They are substantially noiseless in operation. They may be color impregnated as desired. They are designed to function over a wide range of temperatures from −50 degrees Fahrenheit to as high as 400 degrees Fahrenheit. They will absorb shock and vibration, are non-toxic, and have an indefinite shelf life.

These and other objects, features and advantages of the invention will be apparent to those skilled in the art from a detailed study of the description hereinafter with reference to the attached drawings.

SHORT DESCRIPTION OF THE DRAWINGS

DETAILED DESCRIPTION OF THE INVENTION

Figure 1:
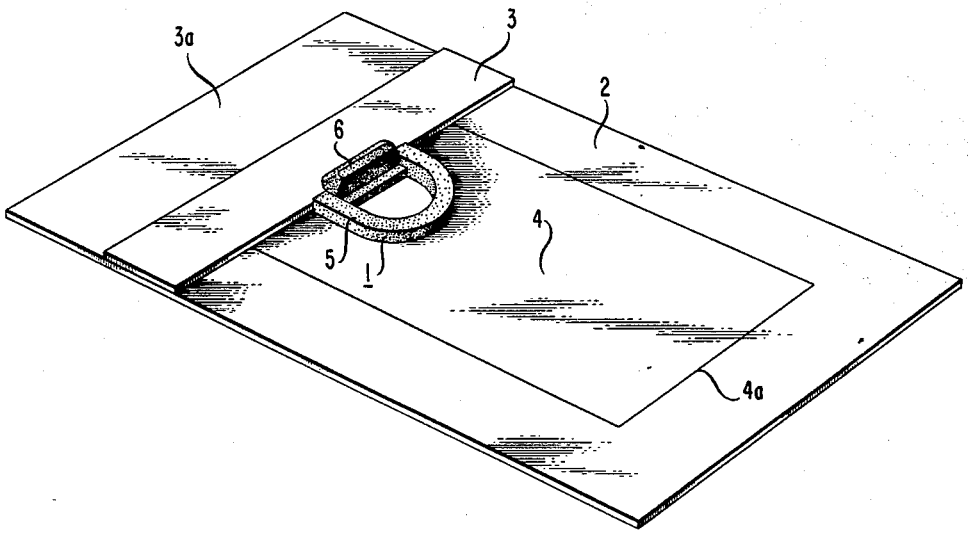
FIG. 1 shows an embodiment of one type of the latch of the present invention installed on a door panel, in closed condition against a striker bar.

FIG. 1 shows a preferred embodiment 1 of the latch of the present invention, which is shaped like a "D" having a body portion 5, at one side of which is a protruding lip 6 forming a catch.

For the purposes of illustration the body portion of the latch 1 as installed in an opening adjacent one end of a door panel 4, the other end **4*a* of which is hinged and mounted to swing to-and-fro in a frame 2**.

The slot or catch formed by the lip 6 is designed, in closed relation, to engage and seat against a striker bar 3 of uniform thickness, of, say, 1/16 inch, which is mounted on the frame **3*a* so as to engage the lip 6**.

Figure 2:
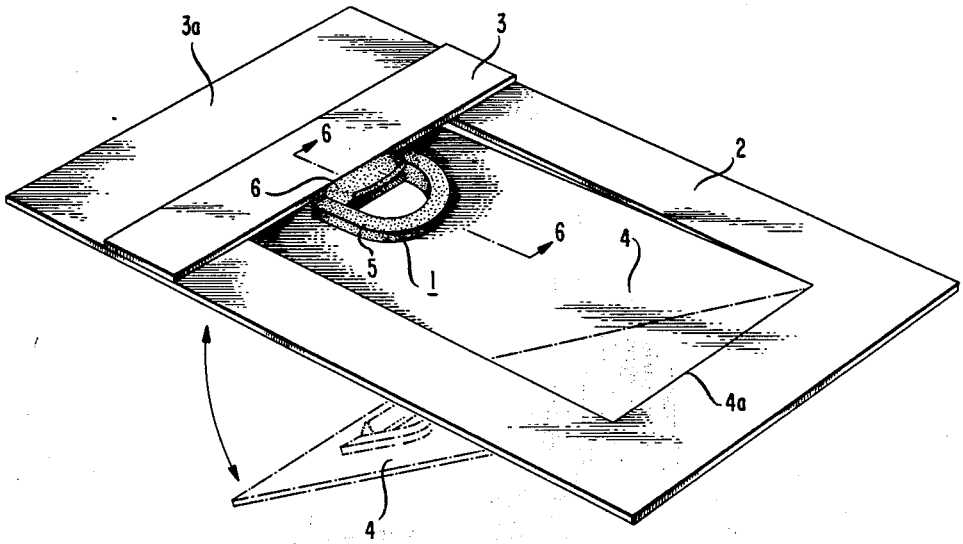
FIG. 2 shows a door, in which the latch shown in FIG. 1 is installed, in the process of being opened.

FIG. 2 shows the underside of the latch being disengaged from the striker plate 3. The fully disengaged position of latch 1 is shown in FIG. 2 in the phantom rendition of the open door panel 4.

Figure 3:
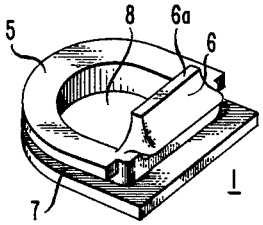
FIG. 3 shows the preferred embodiment of the latch of FIG. 1 removed from the door panel, and disposed with the catch directed upward as viewed from the front.
Figure 4:
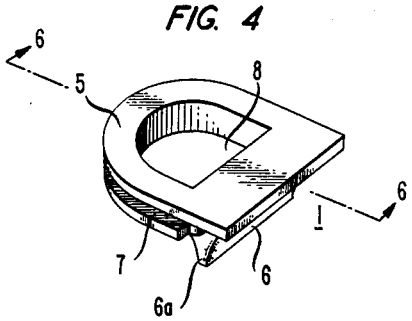
FIG. 4 shows the latch of FIG. 3 with the catch directed downward, viewed from the front.
Figure 5:
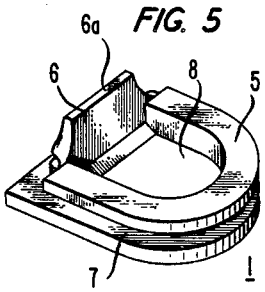
FIG. 5 shows the latch of FIG. 3 with the catch directed upward, viewed from the rear.

FIGS. 3, 4 and 5 are enlarged showings of the D-shaped latch of FIGS. 1 and 2 removed from installation. Each of the latches, or door retention devices described with reference to each of the figures of the attached drawings are formed of elastomer material.

Materials specified for the purposes of the present invention are elastomers, including natural and synthetic rubbers and elastoplastic materials. Examples of typical materials which have functioned well for the purposes of the present invention are listed as follows:

silicone elastomers of formulations manufactured and sold by the General Electric Company, silicone Products Division, RTV Products Department, Waterford, NY, and the Dow Corning Corporation, Midland, MI and others;

a fully vulcanized polyolefinic material comprising fully cured rubber particles dispersed throughout a matrix of thermoplastic material which is sold by the Monsanto Company of Akron, Ohio, under the trademark 'SANTOPRENE';

a vulcanized elastomer product comprising thermoset rubber with thermoplastic material sold by Montsanto Company of Akron, Ohio under the trademark 'GEO-LAST';

a thermoplastic rubber made of traditional thermoset rubber compounds of EPDM, polychloroprene and chlorosulphonated polyethylene which is sold by the Uniroyal Chemical Company, Inc. of Middlebury, CT under the trademark 'ROYALTHERM'; and a polyester elastomer manufactured and sold by E. I. du Pont de Nemours & Co. (Inc.), Polymer Products Department, Wilmington, Delaware under the trademark 'HYTREL'.

It is contemplated that in addition to those materials specifically listed, other elastomer materials having specified characteristics will also be useful for the purposes of the present invention. Typical limits or ranges of parameters exhibited by elastomeric materials which are deemed to be suitable for manufacture of each of the structures disclosed and claimed are indicated in the following Table I.

TABLE I

Suggested Parameters - Elastomers Useful For Patent Invention

| Typical Parameters* | Preferred Range |
|---|---|
| Durometer Hardness | 20–100 Shore A Scale and 0–100 Shore D Scale |
| Ultimate Tensile Strength | at least about 300 pounds per square inch (20.7 Kg/cm.$^2$) |
| Ultimate elongation | at least about 125 percent |
| Tear Strength | at least about 35 pounds per linear inch (6.13 Kg/cm.) |
| Thermostability | at least over the range −30 degrees Fahrenheit to 300 degrees Fahrenheit |
| Ozone resistance | good |
| Fluid resistance (water vapor) | good |
| Compressibility (at room temperature) (D575 Method B) | at least about 10% |

*Parameters as defined in ASMT Handbook

For further information relating to materials suitable for the purposes of the present invention please refer to the following which are incorporated herein by reference:

*Encyclopedia of Chemical Technology* Published by John Wiley & Sons, New York, Third Edition, Copyright 1979 by John Wiley & Sons, Inc., Volume 8, Elastomers, Synthetic (survey), pages 452–635; and Volume 20, Silicon Compounds (Silicones), Silicone Elastomers, pages 943–962.

1986 *Annual Book of ASTM Standards,* Volume 09.01 Rubber, Natural and Synthetic, General Test Methods; Carbon Black, published by the American Society Testing Materials 1916 Race Street, Philadelphia, PA 19103.

Measured across the upper face of the embodiment under description, the "D" is $1\frac{1}{4}$ inches in overall width along its principal axis of symmetry, and $1\frac{1}{4}$ inches along the straight leg of the D. The inner D-shaped opening 8 is 0.060 inches across the axis of symmetry and 0.060 inches along the straight leg.

The thickness of the curved body portion 5, from top to bottom is $\frac{1}{2}$ inch. Substantially centered in the thickness and extending completely around the curved peripheral edge of the D-shaped body 5 is a substantially uniform slot 7, say, 1/16 inch wide and 1/16 inch deep, which is designed to just accommodate the thickness of the panel 4 in which it is installed. (See FIGS. 1 and 2). The catch-forming lip 6 protrudes normally $\frac{1}{8}$ inch from the inside surface on one side of the opening 8, to form a narrow land **6*a* about $\frac{1}{8}$ inch wide and $\frac{5}{8}$ inch long as shown in section in FIG. 6. In this embodiment, the outwardly protruding cam surface forms an angle of 45 degrees with the land 6*a*, extending $\frac{1}{8}$ inch to an edge 6*c*** which extends normal to the plane of the section.

Figure 6:
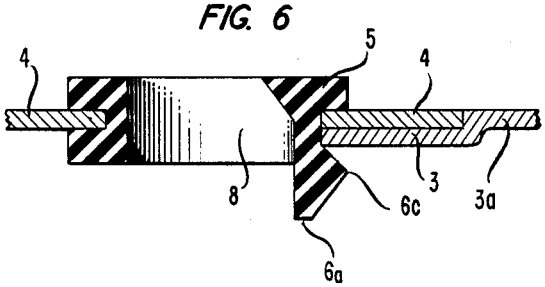
FIG. 6 is an enlarged cross-sectional showing of the latch of FIG. 2 taken along the plane indicated by the arrows 6—6.

As shown in FIG. 6, this is cut back for a distance of 1/16 inch, forming an angle of, say, 30 degrees with the horizontal leg of plate 3. This forms a slot or catch which is $\frac{1}{8}$ inch wide and $\frac{1}{8}$ inch deep and is designed to just accommodate the thickness of the striker bar 3 and the horizontal plane of 4 of the door panel on which the latch rests. (See FIGS. 1 and 2). In the present embodiment, as shown in FIG. 6, when the striker bar 3 and panel 4 are seated in latch 1, the upper surface 5 of the latch body extends vertically $\frac{1}{8}$ inch above the surface of panel 4.

It will be apparent from a study of FIGS. 7–12, which are diagramatic showings of various modifications of the lip 6 which forms the catch, that the angular relationships of the lip surfaces, as viewed in cross-section, are a salient feature of certain of the embodiments of the invention, as this configuration controls the cam-action exerted by the lip 6 to dislodge the striker bar 3 mounted on its supporting surface **3*a*** when the latch is opened, and functions to snap them into place in the catch when the latch is closed.

Figure 7:
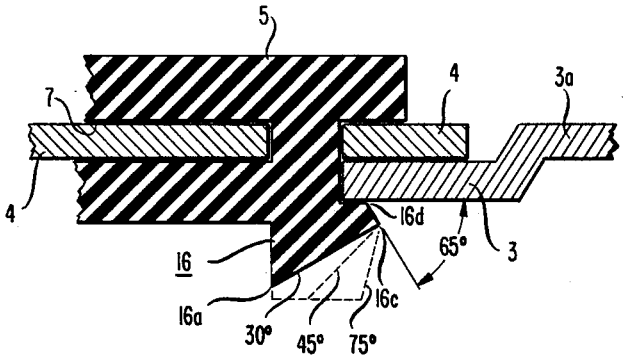
FIGS. 7, 8, 9, 10, 11 and 12 are enlarged cross-sectional diagrams indicating the various angular modifications of the catch member of the latch of the present invention.
Figure 8:
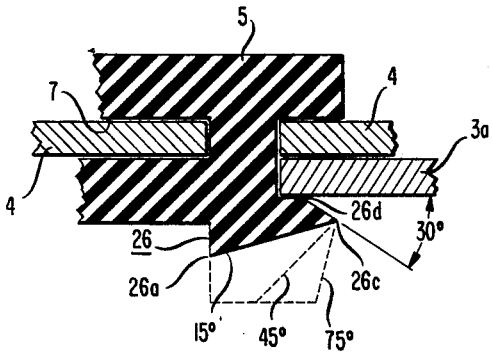

Referring to the enlarged diagram of FIG. 7, it is seen that in the modified lip 16 the inner wall depends in a direction normal to the principal base surface of the latch, terminating at its lower end in a sharp edge **16*a*. In this embodiment the latter is connected to the outwardly-protruding sharp edge 16*c* by a surface which makes a positive 30 degree angle with the horizontal base plane; but which may be varied over the range 30 degrees to 75 degrees, as shown in phatom. In the embodiment of FIG. 7, the protruding edge 16*c* is connected to the undercut edge of 16*d* of the catch by a surface which makes a negative angle of approximately 65 degrees with the base plane of the latch, as measured in cross-section In the latch shown diagramatically in FIG. 8, the downwardly-depending edge 26*a* of the lip 26 bounds a surface which makes a positive angle of 15 degrees with the protruding edge 26*c*. As indicated, in phantom, this angle may be varied through the range 15 degrees to 75 degrees. Protruding edge 26*c* is connected to the undercut edge 26*d*** of the catch by a surface which forms a negative cross-sectional angle of 30 degrees.

Figure 9:
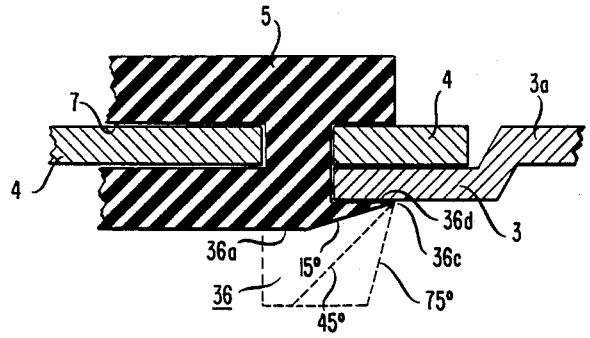

In FIG. 9, undercut catch edge **36*d* of the lip 36 forms a zero angle with protruding edge 36*c*. The cross-sectional angle formed with the base plane by the surface connecting the land 36*a* with protruding edge 36*c*** of the catch is shown as a positive 15 degree angle, but can be varied through a range of angles from 15 degrees to 75 degrees, as indicated in phantom.

Figure 10:
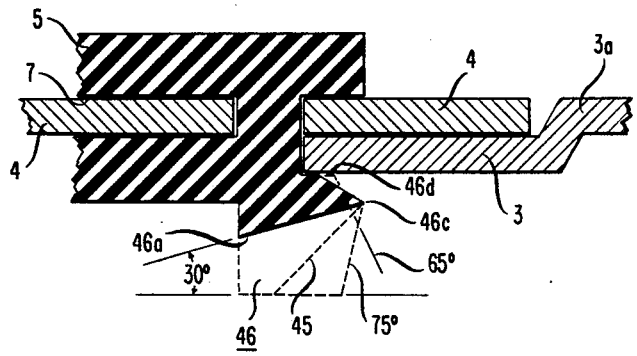

In FIG. 10, although the cross-sectional angle formed with the base plane by the surface extending between the undercut edge **46*d* of the catch and the protruding edge 46*c*** is shown as a negative 4 degree angle, it will be understood that this angle can be varied between 9 degrees and 90 degrees, as shown in phantom.

Figure 11:
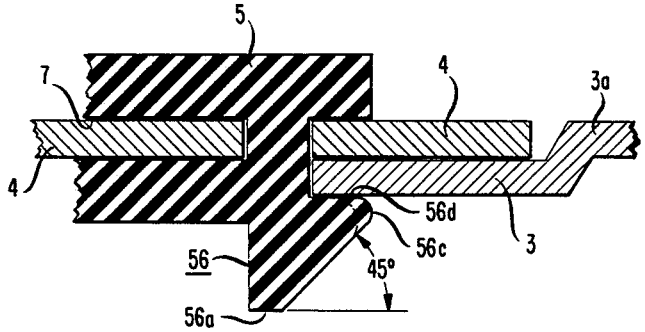

In FIG. 11, the lip 56 depends terminating in land 56*a*, which is connected with a rounded projection 56*c* by a surface forming a cross-sectional angle of 45 degrees with the land 56*a*. The negative angle subtended by the arc of connecting projecting edge 56*c* and the undercut catch surface 56*d* can be varied from 0 degrees to 75 degrees. The radius of curvature of the arc identified by 56*c* is preferably of a value within the range of the thickness of the striker plate 3 and up to 50% greater.

Figure 12:
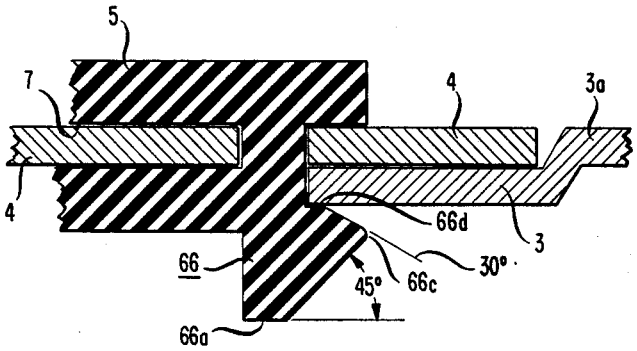

In FIg. 12, the lip 66 depends vertically, terminating in land 66*a*, which is preferably connected to the slightly rounded protruding edge 66*c by a surface forming with the base plane a* 45 degree angle in cross-section, but which angle can be varied between 15 degrees and 75 degrees. The angle formed in the cross-sectional plane by the undercut catch edge 66*d* and the rounded protruding edge 66*c* is 30 degrees in this embodiment, but can be varied from 0 degrees through 65 degrees.

It is contemplated that latches or door retention devices in accordance with the present invention may assume numerous variations.

Figure 13:
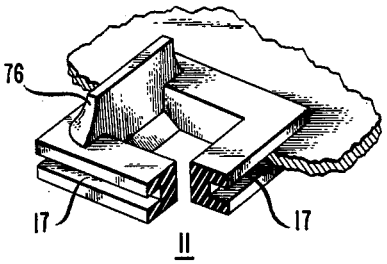
FIG. 13 is an alternative form of the latch of the present invention of rectangular configuration, sectioned on one corner, and installed in a panel.

For example, FIG. 13 shows a latch 11 of open square configuration, 1 inch on a side, ½ inch thick, and having an inner opening ½ inch on a side. The body portion has been sectioned on one corner to show the elastomer material. Latch 11 has a slot 17 surrounding its periphery, which is similar in width and depth to slot 7 of the embodiment of FIGS. 3–6. Extending, say, ¼ inch along one side of the square, is the outwardly protruding catch-forming lip 76 which may have a cross-sectional shape taking any of the forms, or modifications thereof, disclosed in FIG. 7–12, described hereinbefore.

Figure 14:
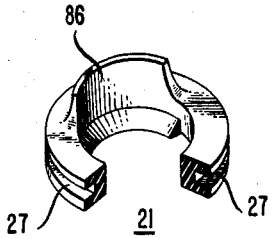
FIG. 14 is a circular latch of the present invention, partially sectioned, with the catch on one side.

FIG. 14 shows a ring-shaped embodiment 21 of the latch of the present embodiment, partially cut away to show the elastomer material. In embodiment 21 shown, the ring is one inch in outer diameter, and ½ inch in inner diameter, and ½ inch thick, having a slot 27 surrounding its periphery similar to in width and depth to slot 7 of FIGS. 3–6. Extending around, say, a 90 degree arc on one side of the ring-shaped latch 21, is a lip 86 forming a catch, which may assume any of the cross-sectional shapes, or modifications thereof, shown and described with reference to FIGS. 7–12.

Figure 15:
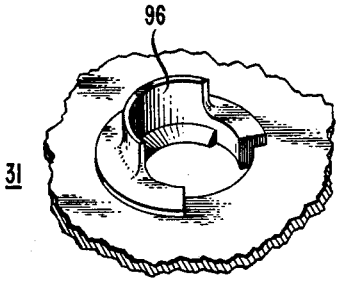
FIG. 15 is a partial circular or "C" latch in accordance with the present invention installed in an opening.

FIG. 15 shows a modification 31 of the latch 21 of FIG. 14, in the form of a C-shaped body, installed in a door or panel. The overall diameter, and thickness and material of latch 31 may be, for example, similar to that of latch 21, except that the former has an opening at one side which subtends ar arc of, say, 45 degrees, opposite which is interposed the lip 96, subtending an arc of, say, 90 degrees, forming a latch member, which is similar in form to those previously described.

Figure 16:
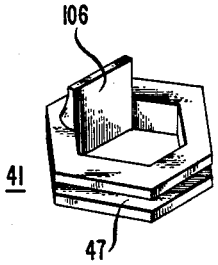
FIG. 16 is a latch in accordance with the present invention in the shape of a polygon with the catch along one edge.

A further modification of the latch of the present invention takes the form of the six-sided polygon 41 shown in FIG. 16 of the drawings, although it will be understood that the polygon may have any number of sides desired. In the embodiment of FIG. 16, the overall width of the polygon 41 is 1½ inches, and the thickness may be similar to embodiments previously described. The slot 47 completely surrounds the periphery, and is of the width and depth of slot 7 in the embodiments of FIGS. 3–6.

Extending ¾ inch along one of the straight edges of the polygonal body of latch 41 is a catch-forming lip 106, which may assume the cross-sectional shape of any of the lips described with reference to FIGS. 5–12.

Figure 17:
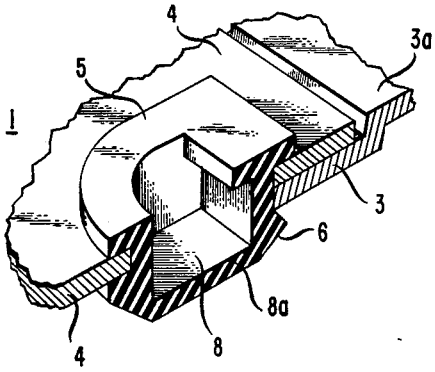
FIG. 17 is a view, looking down from above, of a modification of the embodiment of FIG. 3, partially sectioned along the diametric plane to show a closed base portion.

It will be understood that any of the embodiments shown and described hereinbefore can be further modified. For example, FIG. 17 shows a cross-sectional view of a modification of the "D"-shaped latch of FIGS. 3–6 in which the opening 8 is closed on one side by a panel 8*a* of uniform thickness of, say, 1/32 inch. It will be understood that any of the other disclosed embodiments can be similarly modified.

Figure 18:
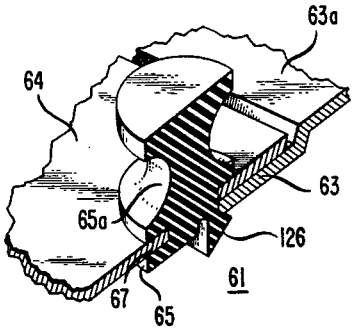
FIG. 18 shows in diametric section, installed, a latch in accordance with the present invention of circular configuration in its principal plane, having a circular handle.
Figure 19:
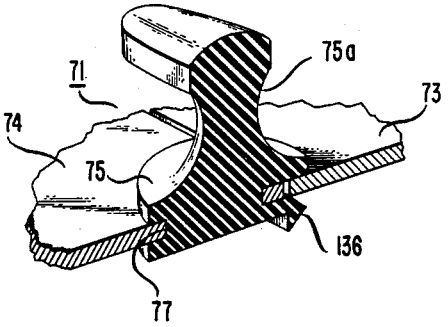
FIG. 19 shows in cross-section, installed, a latch in accordance with the present invention of elliptical configuration in a principal plane, having an elongated handle.

Furthermore, instead of the opening 8 as shown in FIGS. 3–6, a handle or knob can be attached to one of the major surfaces of the latch to facilitate grasping and opening the latch. Such a modification is shown in FIGS. 18 and 19. For example, the "D"-shaped latch 61 of FIG. 17 has a body portion 65 of similar thickness and overall dimensions of that shown in FIG. 3–6, in that it includes a peripheral slot 67, and a catch forming lip 126, which are as previously described. However, the knob or handle 65*a*, which may be circular or "D"-shaped, or in the form of a polygon, protrudes normally from one of the major surfaces, in a direction opposite to the catch-forming lip 126. Similarly, in latch 71, an elliptical knob or handle 75*a* is attached to protrude in a normal direction from the major surface of the body 75, in a direction opposite to the depending lip 136. The upper face of the elongated handle 75*a* can be molded or embossed to carry any desired tradmark or insignia. An important feature of the embodiment shown in FIG. 19, is that no separate striker bar is needed. This permits the latch to be installed on the door panel 74 without the addition of an auxiliary part.

Figure 20:
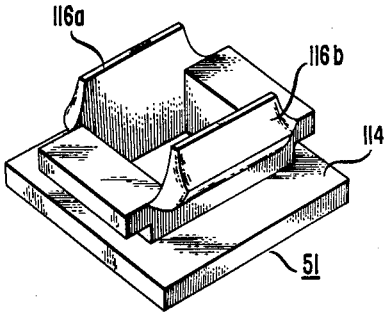
FIG. 20 shows a modification of the rectangular latch of FIG. 13 which includes catches on opposite edges.
Figure 21:
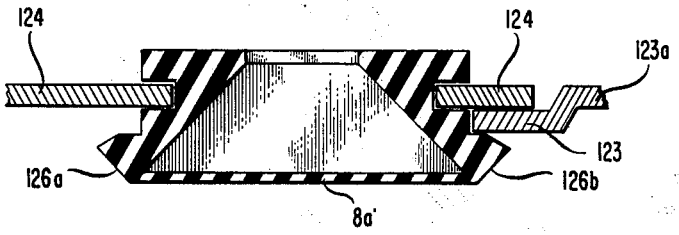
FIG. 21 is a showing, in section of modification of the latch of the present invention of square configuration, showing a closed base portion, and latches on opposite sides.

A further modification of the latch of the present invention which may greatly increase its service life, is to interpose one or more additional catch-forming lips, which will enable the latch to be merely rotated to a new position if one of the lips becomes worn. Such an arrangement is illustrated in latch 51 of FIG. 20, which is substantially similar to square latch 11, as previously described, except for the fact that it has two catch-forming lips 116*a* and 116*b* disposed on diametrically opposite sides of the square, each substantially identical to 76. It will be apparent that corresponding additional lips can be added to the other two sides of latch 51, if desired; and that a similar modification can be applied to any of the latches previously described. FIG. 21 is a cross-sectional showing of a modification of the embodiment of square configuration shown in FIG. 20, having one side 8*a* closed, and having catch member 126*a* and 126*b* protruding from opposite sides. It is contemplated that a circular embodiment can be formed with similar cross-sections. In these embodiments, the holding area is independent of the latching area. Therefore, the catch can be formed to extend 360 degrees in a circular embodiment, or can be on all sides of a multifaceted latch.

Another modification of the invention shown in FIGS. 22–26 is a longitudinal extension of the latch arrangement of the present invention which will be denoted 'the line latch'.

Figure 22:
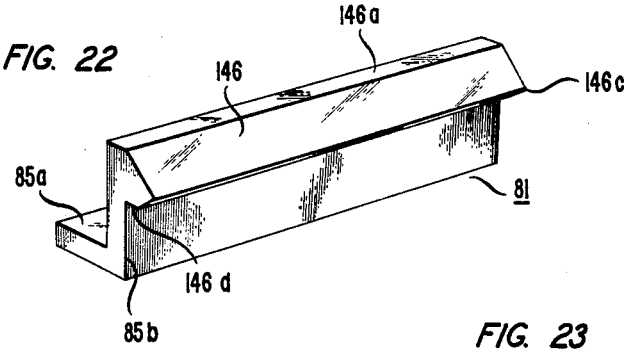
FIG. 22 is a perspective showing of a line latch in accordance with the present invention.
Figure 23:
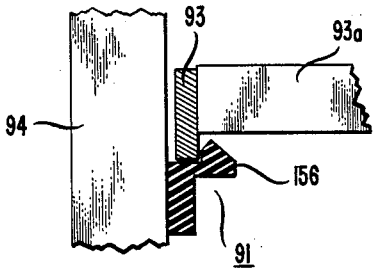
FIGS. 23 and 24 are sectional showings of the line latch of the present invention, installed on a vertical plane, and a horizontal plane, respectively.

Referring to FIG. 22, there is shown a latch configuration 81 which may comprise, for example, a body portion 85*a*, which in the embodiment illustrated is ⅜ inch in overall width, and ⅛ inch thick disposed along one edge of which, in normal relation to 85*a*, is a panel 85 of substantially the same thickness, extending up vertically, and terminating in a narrow, rectangular land 146*a*, say, ⅛ inch wide. Projecting downwardly and outwardly from land 146*a* at an angle which may, for example, be 45 degrees, is the lip 146 which terminates in the projecting edge 146*c*, which is undercut at an angle of, say, 30 degrees to intersect the undercut catch member 146*d*. Although specific angles have been indicated by way of example, it will be understood that any of the other angular relationships discussed in FIGS. 7–12 for the catch-forming lip may be applied to this embodiment. It is contemplated that this line latch, which will be of elastomer material of the same type previously described with reference to the other embodiments, may be sold in strips which are cut off to any desired length. For example, as shown in FIG. 23, a length of "line latch" 91 with the lip 156 oriented to protrude outwardly, may be secured lengthwise, horizontally in a direction normal to the plane of the drawing, along the face of a door 94, which is hinged to open and close against a horizontally-elongated striker bar 93 which, for example, is secured to the end of a shelf 93*a*.

Figure 24:
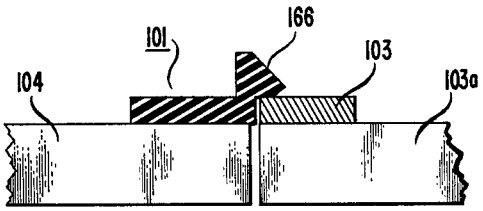

Another configuration is illustrated in FIG. 24, in which the horizontally-elongated body of a line latch 101 is secured along the horizontal surface of a door 104, so the latch-forming lip 166 protrudes so that when the door 104 is closed, it just accommodates the horizontally-elongated striker bar 103 which is secured to the surface of stop 103*a*. Either of the latches 91 or 101 shown in FIGS. 23 and 24 can, in the alternative, have projecting lips 156 and 166 on both sides, so that they can be turned over if worn out on one side.

Figure 25:
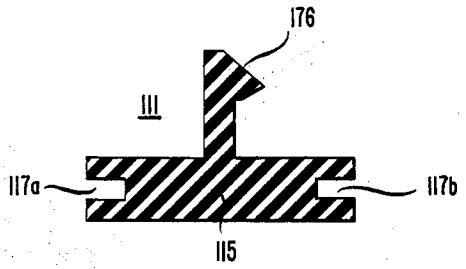
FIG. 25 shows in section, a modification of the line latch of FIG. 22.

As another alternative the line latch 111 can assume the form shown in FIG. 25, in which the catch-forming lip 176 protrudes in a direction normal to the elongated body portion 115, which in the present embodiment is 1 inch wide and $\frac{1}{4}$ inch thick, having elongated slots 117*a* and 117*b* on opposite sides which are dimensioned to securely accommodate the edges of the door or panel on which it is installed. The strip can be cut to any desired length in a direction normal to the plane of the drawings. Latch 111 can be double-sided so that catch 176 is formed to protrude in opposite directions simultaneously. Further, this design, as shown in section lends itself to the possibility of a latch having a four-sided holding area.

Figure 26:
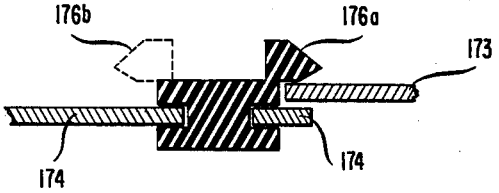
FIG. 26 shows in section a modification of the line latch of FIG. 25, installed, with the catch directed to the right, or, alternatively, reversed, as shown in phantom.

FIG. 26 shows, in section, a further modification of the line latch disclosed in FIGS. 22–25 installed along the edge of a door or panel, perpendicular to the plane of the drawing, so that the catch-forming lip 176*a* projects over and forms a catch for striker bar or panel 173. As an alternative, a second catch forming lip 176*b* may be formed along the opposite lip, so that the latch strip may be reversed if lip 176*a* becomes worn, or engaged in a slot in which greater pull is required.

Figure 27:
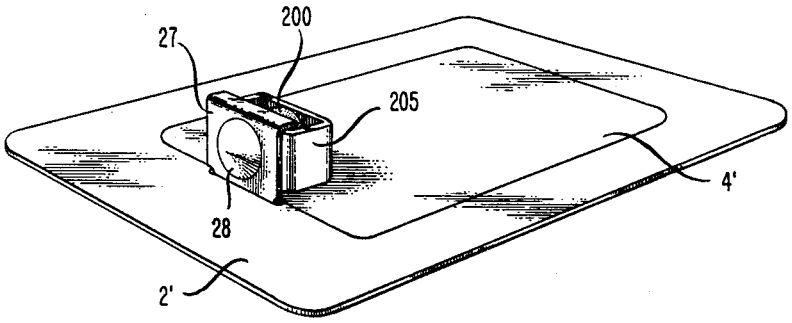
FIG. 27 shows a modified type of latch of the present invention which terminates in an elastically deformable bulb or button installed in a door in closed condition against a striker bar.
Figure 28:
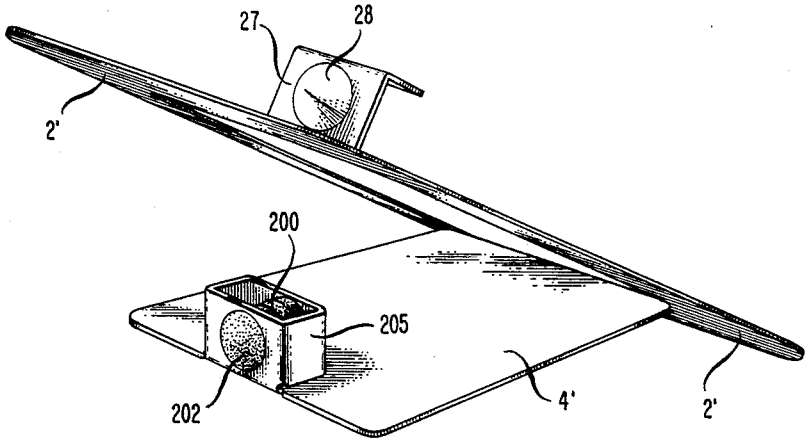
FIG. 28 shows a door in which the latch shown in FIG. 27 is installed, in the process of being opened.

Referring to FIGS. 27 and 28 there is shown a modified bulb or button latch of the present invention installed in a door, which is respectively shown, first in 'closed', and then in 'open' condition.

Figure 29A:
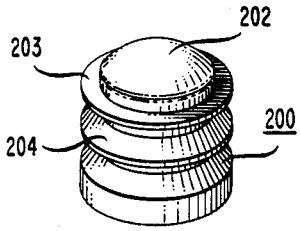
FIG. 29A shows in detail the latch member indicated in FIGS. 27 and 28, which terminates in an elastically deformable bulb or button.

The latch element shown installed in FIGS. 27 and 28 is shown as element 200 in side elevation in FIG. 29A, removed from the housing. This comprises an overall molded hollow or alternatively solid cylindrical body of an elastomer material, such as described with reference to the latch element in FIGS. 1–3, which has an overall outer diameter of, say, $\frac{1}{2}$ inch, an axial length of the cylindrical portion of, say $\frac{5}{8}$ inch, and a wall thickness of, say, $\frac{1}{8}$ inch, or it can be solid in the alternative form. The lower end 201 has a round opening 208 say, $\frac{1}{4}$ inch in inner diameter which runs the length of the cylinder. The upper end of the cylinder is closed having a centered semi-spherical solid elastomer bulb or button 202, with a radius of curvature of, say $\frac{5}{8}$ inch surrounded by an annular shoulder 203 which is say, 1/16 inch wide. (See FIG. 30B).

The bulb or button 202 projects out, say, 0.150 inch from shoulder 203. The body portion of the cylinder is striated in planes normal to the axis with a plurality of parallel peripheral grooves 204, each of which is say, $\frac{1}{8}$ inch wide and say, 1/16 deep, and the bottoms of which grooves are spaced-apart say, $\frac{1}{8}$ inch in an axial direction, so that the cylindrical body has the appearance and function of a bellows, subject to being depressed in an axial direction in response to pressure against the bulb or button 202.

Figure 29B:
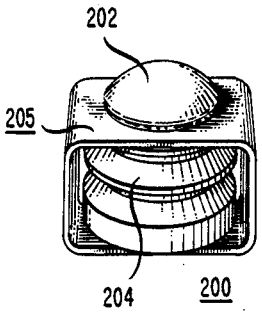
FIG. 29B shows the latch member of FIG. 29A in a metal housing.
Figure 29C:
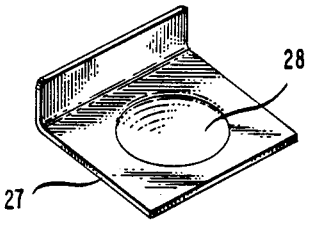
FIG. 29C shows a metal striker bar having centered dimple for accommodating the latch of FIG. 29B.

In one embodiment shown in FIG. 29B, the latch element 200 is disposed centrally in a hollow rectangular metal housing 205 which is say, 0.600 inch wide, and say, 0.900 inch long, and say, $\frac{1}{2}$ inch deep. Housing 205 is closed on at least two opposite sides, and closed at the bottom except for a small central opening. The top is closed except for a round opening through which the bulb 202 projects. The housing 205 may be screwed or otherwise fastened in one of its closed sides to the inside edge of a door panel, so that the bulb or button 202 projects beyond the edge of the door. A metal striker bar or surface 27, which may take the form shown in FIG. 29C, is fastened to a corresponding position on the door jamb so that when the door is closed it just accommodates the bulb or button 202 in elastically deformed position in a semi-spherical dimple 28, which may have a diameter of, say, $\frac{1}{2}$ inch, and be say, 0.100 inch deep.

Figure 30A:
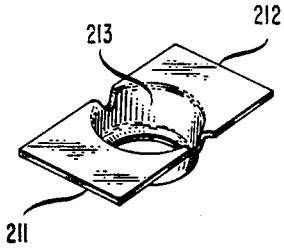
FIG. 30A shows a metal housing for a modification of the latch member of FIG. 29A.
Figure 30B:
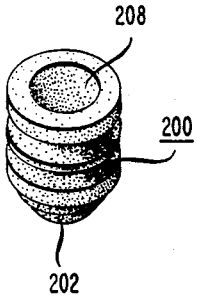
FIG. 30B shows a latch member, suitable for the housing of FIG. 30A, as viewed from the open end.
Figure 30C:
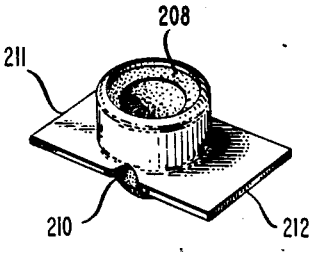
FIG. 30C shows, in side elevation, the latch member of FIG. 30B mounted in the housing of FIG. 30A, as viewed from the underside.

Another modification of the housing of the bulb or button latch is shown in FIGS. 30A, 30B and 30C. This housing 210 may comprise a thin metal plate, such as, stainless steel, having a central receptacle having a semi-spherical interior say, 0.600 inch in diameter across the top, and say, 0.750 inch across the circular opening at the bottom, a pair of flat, rectangular ears 211, 212, say, 0.900 inch wide, and say, $\frac{1}{2}$ inch long, are bent back from opposite sides of the top for the purpose of screwing or otherwise securing the housing to a flat surface near the inner edge of a door. FIG. 30B shows a bulb or button type latch member, such as 200 in FIG. 29A, which is constructed for installation in the metal housing 210. FIG. 30C shows, in side elevation, the bulb or button latch 200 installed in the housing 210, which may be screwed or otherwise secured near the edge of a door so that the bulb or button 202 projects out from the edge. The striker bar may be a flat metal plate, or a dimpled plate, as shown in FIG. 29C.

Figure 31A:
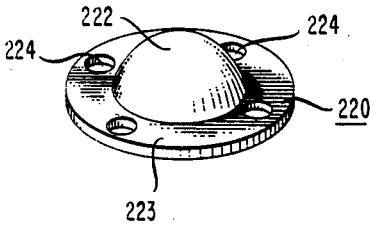
FIG. 31A shows a top view of a shortened version of the bulb or button latch of the present invention having a wide annular flange.
Figure 31B:
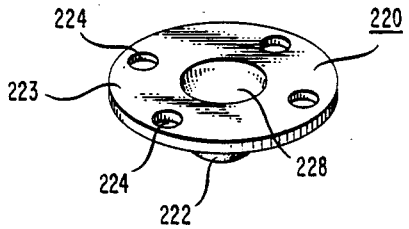
FIG. 31B shows the bottom view of the bulb or button latch of FIG. 31A.

FIGS. 31A and 31B show a further modified form 220 of the bulb or button latch member, in which the centered semi-spherical bulb 22 or protuberance is say, $\frac{1}{2}$ inch in diameter, and projects say, 0.0150 inch out from the surface. This is surrounded by an annular flange 223, say, $\frac{1}{4}$ inch wide and say, 1/16 inch thick, and having four symmetrically-spaced screw holes 224. FIG. 31B shows the back view of latch 220, showing the central opening 228. It is apparent that this type of latch can be screwed or otherwise secured to a flat surface so that the bulb or button 222 projects out from the surface. It is contemplated that the striker bar used with this type of latch could be a plain metal strip, or a dimpled receptacle such as shown in FIG. 29C.

Figure 32A:
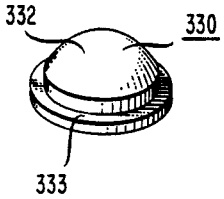
FIG. 32A shows a top view of a further modification of the bulb or button latch, having a narrow annular rim.
Figure 32B:
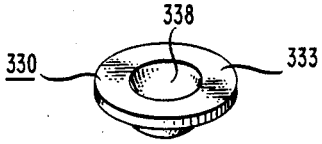
FIG. 32B shows the bottom view of the bulb or latch of FIG. 32A.
Figure 32C:
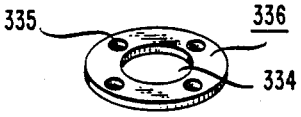
FIG. 32C is a metal retaining ring for the latch of FIGS. 32A and 32B.

FIGS. 32A and 32B show top and bottom views, respectively, of still another modification 330 of the bulb or button latch. The semi-spherical bulb or protuberance 332 is say, $\frac{1}{2}$ inch in diameter and projects out say, 0.100 inch, and is surrounded by a narrow annular rim 333 say, 1/16 inch wide, and say, 1/16 inch thick. In the bottom view shown in FIG. 32B, the central opening 338 is shown, which is say, ⅜ inch in diameter. FIG. 32C shows a metal retaining ring 336 which fits on top of flange 333 having a central opening 334, say, ½ inch in diameter, which just accommodates bulb 332, and a plurality of screw holes 335. The retaining ring 336 is screwed into place trapping annular rim 333 against the mounting surface.

Figure 33A:
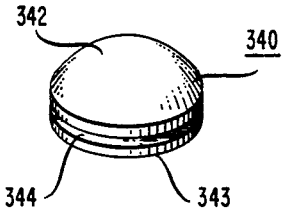
FIG. 33A is a top view of another modification form of the bulb or button latch having an annular groove inside of a narrow annular rim.
Figure 33B:
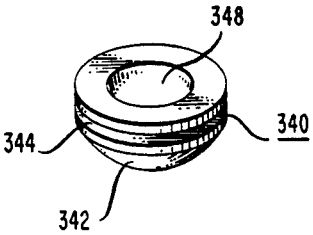
FIG. 33B is a bottom view of the bulb or button latch of FIG. 33A.

FIGS. 33A and 33B show another modification similar to that shown in 32A and 32B, except that the base of the button or bulb 342, (which is similar to 332) is surrounded by a groove 344 which is say, 1/16 in wide and say, 1/16 inch deep. The rim 343 is similar to rim 333; and opening 348 is the same size as 338.

It is contemplated that latch members 330 and 340 can be secured to the desired edge surface of a door by nesting groove 344 (snapped in place) against the edge surface.

It will be understood that, although the bulb or button latches have been shown to be semi or hemi-spherical, it is contemplate that the latches may assume any desired shape such as square, polygonal, or even an irregular shape, as long as the lip or protuberance projects out in such a manner that it is elastically deformed and engaged by the surface against which the latch is closed. The positions of the latch and striker bar may be reversed. For example, the latch may be disposed in the door frame, and the striker bar on the edge of the door with which it is constructed to engage.

Figure 34:
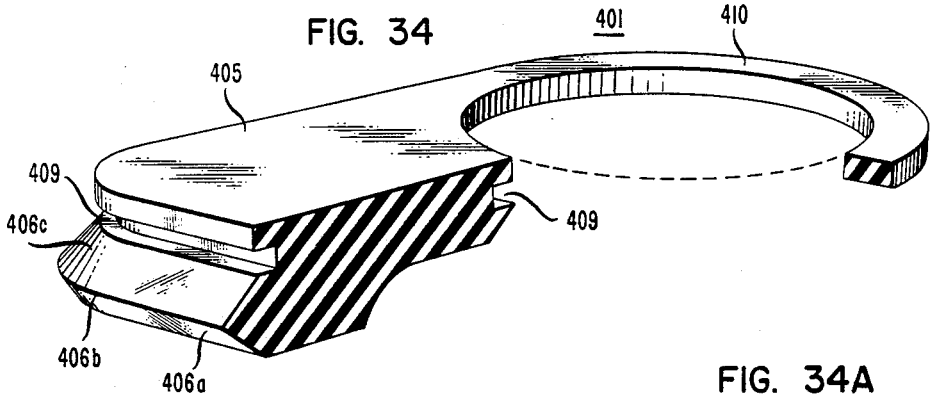
FIG. 34 shows, in perspective, partially cut away, a tab latch in accordance with the present invention having a shallow groove surrounding the latch element which is constructed to engage the edge of a slot in the closure in which it is installed.
Figure 34A:
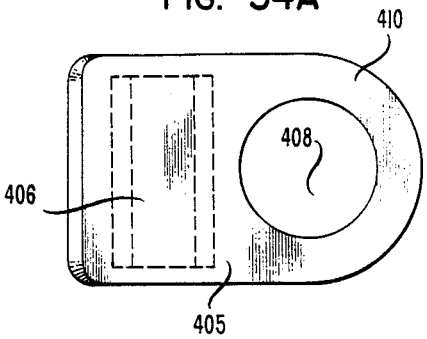
FIG. 34A shows a top view of the tab of FIG. 34.

Referring to FIG. 34, there is shown in perspective, with a portion cut away, a tab latch 401 in accordance with the present invention. Referring to the top view 34A, the body of the tab latch 401 is U-shaped, 1-5/16 inch along its long axis, and 1 inch wide across its straight end. Centered ½ inch from the curved end is a circular opening 408, which is 9/16 inch in diameter, forming with the curved edge of the body 405 a manually accessible ring or handle 410.

Disposed on the underside of the body 405 is a catch 406 which is rectangular in outline, as shown in the top view 34A, being centered parallel to and ⅜ inch from the straight edge, and extending 1 inch in overall length, and ⅝ inch in overall width. A lip or catch 406, say, ¼ inch thick, comprises angular surfaces **406*a* and 406*c* which project out say, 45 degrees in opposite angular directions, extending a lateral distance of, say, 1/16 inch beyond the edge of body 405, forming between them a projecting ridge or protuberance 406*b* having an internal angle approximating 90 degrees in the vertical plane. 3/32 inch below the upper surface of body 405 and just above projecting surface 406*c*, is a groove 409 of rectangular section, 1/16 inch wide and 1/16 inch deep, which completely surrounds the catch member 406**.

Figure 34C:
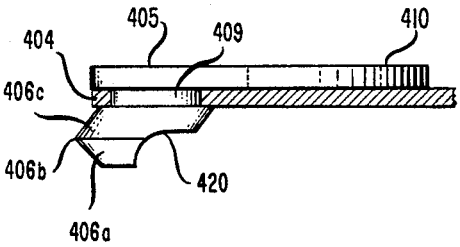
FIG. 34C shows a side elevation of one embodiment of the tab latch of FIGS. 34, 34A and 34B, which has a single lip.
Figure 34B:
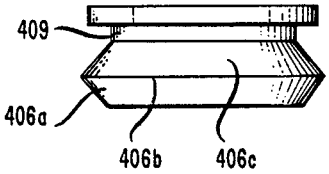
FIG. 34B shows a front elevational view of the tab latch of FIGS. 34 and 34A.
Figure 34D:
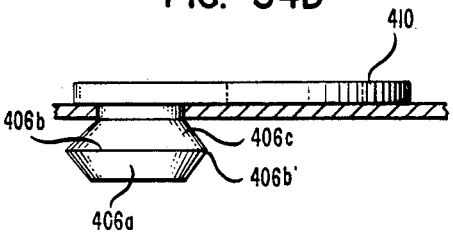
FIG. 34D shows a side elevation view of another embodiment of the tab latch of FIGS. 34, 34A and 34B, which has a double lip.

In one embodiment of the tab latch, as shown in FIG. 34D, the catch member 406 is ¾ inch wide, and the ridge **406*b* completely surrounds the catch, providing external and internal catch projections 406*b* and 406*b*'. In another embodiment, as shown in FIG. 34C, the rear portion of catch member 406 is undercut as indicated by 420 to remove the internal catch 406*b*'**.

As shown in FIG. 34C, it is contemplated that latch 401 in either of its embodiments, can be snapped into place so that it sets on the edges of an opening cut or punched in the supporting surface, which conforms to the inner perimeter of the groove 409.

Figure 35:
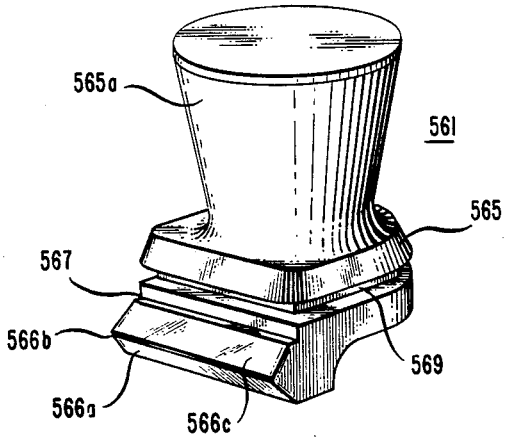
FIG. 35 shows, in perspective, a knob latch similar to that shown in FIG. 18, which has been modified to include a shallow groove surrounding the latch for accommodating the edge of a slot in the closure.

FIG. 35 shows a knob latch 561 in accordance with the present invention which is a modification of the knob latch illustrated in FIG. 18.

This comprises a knob or handle **565*a*, which is frustoconical, having a diameter of 7/16 inch at the top, being tapered to a diameter of ¼ inch, ¼ inch below the top, an4d flaring out to a diameter of ⅜ inch at the base 565, 1/16 inch below the sides, being curved outwardly from the plane of smallest diameter. The knob 565*a* is integral with base member 565. The latter, for example, is of U-shaped outline, being, say, 7/16 inch across its straight front portion, ½ inch in overall width from front to back, and ⅛ inch thick. The edges of base portion 565 project outwardly at a slight angle, say, 45 degrees in the vertical plane. Base 565 measures ½ inch across the front and ½ inch from front to back, through a horizontal plane conforming to its lower edge. The body portion of the latch 561 depending from the base portion 565 includes a catch 566. The latter comprises a pair of flat surfaces 566*a* and 566*c*, ½ inch long, which project outward to substantial alignment with the lower edge of 565, forming a projecting ridge 566*b*, and forming between them an angle slightly less than 90 degrees. The projecting ridge 566*b* extends across the front of the latch 561, substantially co-linear with the front edge of the base 565. The full thickness of catch 566 extends back 3/16 inch from its forward end to an undercut portion 560**, which is indented ⅛ inch from the lower surface.

Along the upper edge of catch 566 is a flat, oblong groove 567 ½ inch long and 1/16 inch wide, cut into the body of the latch, forming a recess 1/16 inch high. This is constructed to accommodate the end of the flat striker bar lip **563*a*, which may be of metal having a thickness of, say, 1/16 inch. The latter is formed integrally with the cabinet or panel surface 563, and is cnstructed to form on its upper surface a rectangular recess 563*b*, say, 1/16 inch deep, to mate with and accommodate the edge of panel 564**.

Figure 35A:
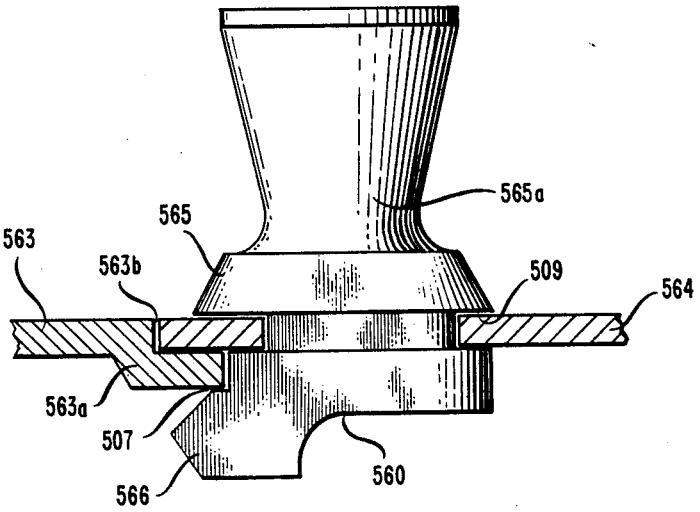
FIG. 35A shows, in partial vertical section, the latch of FIG. 35 in accordance with the present invention.

A particular feature of this embodiment is a nesting groove 509, which is cut into the body of latch 561, flush with, and substantially normal to the upper edge of recess 567. The nesting groove 569, which is constructed to accommodate the thickness of a punched out hole or slot cut in the panel door or closure 564 (See FIG. 35A), is, say, 1/16 inch wide and 1/16 inch deep surrounding the rear and sides of 561. Across the straight front portion, the outwardly projecting portion of 565 forms an overhang extending say, 1/16 inch out from the inner wall of groove 569. Thus, the latch is readily snapped into and held in place in the slot or punched out opening and is protected from being displaced by multiple openings and closings of the latch.

Figure 36:
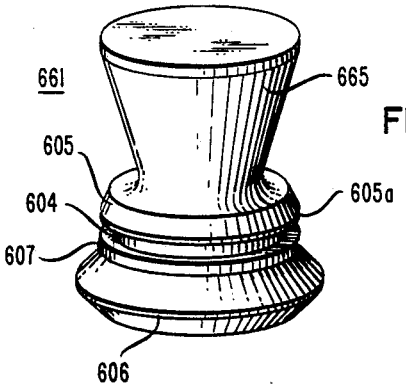
FIG. 36 shows, in perspective, a round latch in accordance with the present invention which is symmetrical about its central axis, and includes an annular groove for accommodating the edge of around slot in the closure in which it is to be installed.
Figure 36A:
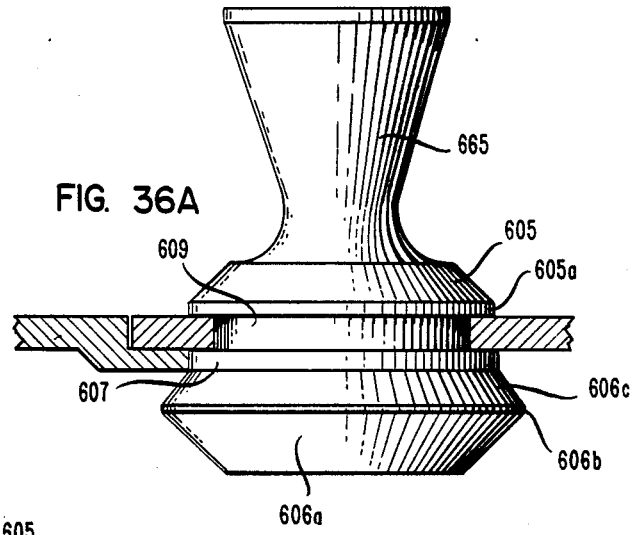
FIG. 36A shows a side elevation, of the round latch.
Figure 36B:
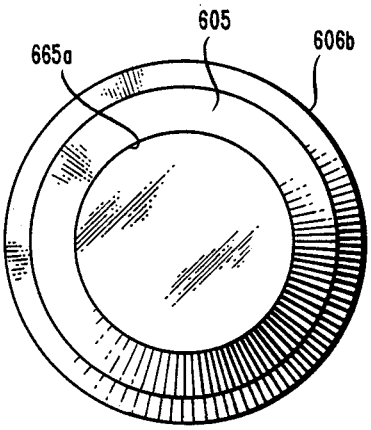
FIG. 36B is a top view of the round latch of FIG. 36A.

A further modification of the knob latch 561 of FIGS. 35 et seq. is the round latch 661 shown in FIGS. 36, 36A and 36B, which is symmetrical about its principal axis.

In latch 661, the knob 665, which is formed integrally with the body, is substantially similar in shape to the knob 565 of latch 561. The knob 665, which in the presently described embodiment is ½ inch across the top, is centered on, and co-axial with the base 605, which is ⅝ inch in diameter in a plane conforming to its lower edge, the sides projecting out in frustoconical fashion, from the base of the handle.

The catch 606, is annular, co-axial with the knob 665, and comprises a pair of frustoconical annular surfaces **606*a* and 606*c*** which intersect at an internal angle of, slightly less than 90 degrees to form an annular ridge 606*b* which projects, say, 1/16 inch laterally beyond the edge of 605*a*.

At the upper edge of the annular catch member 606 is a cylindrical ring 607, having a surface parallel to the axis. The ring 607 is, say, 1/16 inch high, and having an outer diameter which substantially conforms to 605*a*.

Between 605*a* and 607 is an annular rectangular groove 609, 1/16 inch deep, and 1/16 inch wide. The groove 609 functions to accomodate the edge of a slot or hole cut or punched out of the door or closure panel, so that the round latch may be readily snapped into place without the necessity of tools.

A particular advantage of the round latch is that, in addition being easily installed or removed, it may simply be rotated to a different position when the catch on one side is worn.

Although the invention has been described with reference to anumber of specific embodiments, it will be understood that the invention is not limited by the specific forms or dimensions disclosed by way of illustration, but only by the scope of the appended claims.

What is claimed is:

1. A one-piece door or panel retention device for latching against a striker bar or surface comprising a solid body of elastomeric material having a durometer hardness on the Shore A scale of between 20 and 90, a tensile strength between 550 and 2000 pounds per square inch (3.65 and 146.14 Kg/cm$^2$), and a tear strength of between 75 and 300 pounds per linear inch (0.89 and 53.57 Kg/cm.), having along one edge thereof an outwardly-projecting lip forming a catch on an undercut surface of said lip, an outwardly-directed surface of said lip comprising a cam, at least a portion of which is constructed in closed relation of said latch to form a positive cross-sectional angle of between 15 degrees and 90 degrees with a plane parallel to a striker bar or surface of a panel wherein said door or panel retention device is installed.

2. A one-piece door or panel retention device in accordance with claim 1 wherein said cam comprises a pair of surfaces which intersect for forming a protruding edge elongated in a plane normal to said protruding edge, wherein the outer of said surfaces of said pair is constructed in closed relation of said latch to form a positive angle of between 15 degrees and 90 degrees with a plane parallel to said striker bar or surface, and wherein the inner surface of said pair is constructed in closed relation of said latch to form an angle of between 0 and 90 degrees with a plane parallel to said striker bar or surface.

3. The one-piece door or panel retention device in accordance with claim 1 wherein said protruding edge is rounded.

4. A latching device for installation in or on a panel for latching said panel to a striker bar which device comprises a one-piece solid body of elastomeric material having a principal plane which, upon installation, is substantially parallel to the surface of said panel, said latching device having a latching lip which protrudes outwardly from the edge of said body in a direction both parallel to and normal to said principal plane, said lip cut on an inwardly-directed surface to form a catch which is constructed and arranged to just accommodate the thickness of said striker bar in latching relation, an outwardly directed surface of said latching lip comprising a protuberance for elastically-deformable engagement with said striker bar, at least a portion of the outwardly-directed surface of said protuberance forming in a cross-sectional plane an acute angle within the range 15 degrees to 75 degrees with a plane parallel to said principal plane;

means for securing the installation of said body in or on said panel comprising an elongated slot in the peripheral edge of said one-piece body which is constructed to just accommodate the thickness of said panel;

wherein said body comprises a structure forming a "D" in said principal plane, wherein said elongated slot is interposed continuously around the peripheral edge of said "D", and wherein said lip cut on an inwardly-directed surface to form said catch depends and protrudes outwardly from the straight portion of said "D".

5. A latching device in accordance with claim 4 wherein one major surface of said "D"-shaped latch is open and the opposite major surface thereof is closed.

6. A door or panel retention device constructed and arranged for installation in or on a rigid panel for latching said rigid panel to a striker bar or surface on a rigid panel, which device comprises a one-piece body of elastomer material consisting essentially of natural or synthetic rubber or elastoplastic material having durometer hardness within the range 20 to 100 on the Shore A scale and 0–100 on the Shore D Scale, an ultimate tensile strength of at least about 300 pounds per square inch, (21.9 Kg/cm$^2$), a tear strength of at least about 35 pounds per linear inch (6.24 Kg/cm.), an ultimate elongation of at least about 125%, and a compressiblity of at least about 10%, comprising means for rigidly fastening said body to said panel, said one-piece body comprising a latch having at least one protuberance which is constructed and arranged at least one protuberance which is constructed and arranged when installed in said panel to project outwardly adjacent the edge of said panel in a direction normal to the edge of said panel, said outwardly-directed protuberance being constructed to engage in elastically-deformable relation with a transversely-disposed surface of said striker bar or surface when said door or panel retention device is being closed with reference to said striker bar or surface, and to disengage in elastically-deformable relation from said striker bar or surface when said retention device is opened.

7. The door or panel retention device in accordance with claim 6 wherein said protuberance comprises a semi-spherical bulb or button.

8. The door or panel retention device in accordance with claim 7 wherein said one-piece body is in the form of a hollow or solid cylinder wth peripheral striations in a series of parallel planes normal to its principal axis, and wherein said cylinder has a closure at one end in which said semi-spherical bulb or button is centered.

9. The door or panel retention device in accordance with claim 8 wherein said means for rigidly fastening said body to said panel comprises a hollow metal housing for confining said body except for said bulb or button which projects beyond the end of said housing, said housing having projecting members for fastening said housing to said surface.

10. The door or panel retention device in accordance with claim 7 which comprises an annular rim integrally formed with and surrounding said semi-spherical bulb or button, said rim having a flat under surface constructed to be secured to the surface of said panel.

11. The door or panel retention device in accordance with claim 10 wherein said rim comprises a plurality of screw holes spaced-apart around its periphery for securing said rim to the surface of said panel.

12. The door or panel retention device in accordance with claim 10 wherein an annular groove is formed at the base of said bulb or button.

13. A door or panel retention device in accordance with claim 6 wherein said elastomeric material has a durometer hardness on the Shore A Scale within the range of 20 to 90, an ultimate tensile strength within the range 550 to 2000 pounds per square inch (3.65 to 146.14 $Kg/cm^2$), and a tear strength within the range 75 to 300 pounds per linear inch (0.89 and 53.57 Kg/cm.).

14. A door or panel retention device in accordance with claim 6 including a handle having a base integrally formed on one surface of the body of said device, wherein said protuberance is in the form of a catch which projects from another surface of said body, transverse to said one surface, said catch being constructed and arranged to project outwardly adjacent the edge of said panel when said catch is installed in said panel;

a nesting groove surrounding the body of said door or panel retention device between the base of said handle and said catch, said groove constructed and arranged to seat edgewise on an opening in said panel when said latch is installed in said panel.

15. A door or panel retention device in accordance with claim 14 wherein said handle comprises a substantially flat tab extended out laterally in cantilever fashion from said integrally formed base, and including a member freely suspended at one end and sized for grasping and raising by a user of said door or panel retention device.

16. A door or panel retention device in accordance with claim 15 wherein said freely suspended member includes an opening sized to accommodate at least one finger of a user of said device.

17. A door or panel retention device in accordance with claim 15 wherein said catch is double edged, having a first and second edge disposed in substantially parallel, spaced-apart relation in a plane parallel to the principal plane of said door or panel retention device, one said edge directed outwardly, and the other said edge directed inwardly.

18. A door or panel retention device in accordance with claim 14 wherein said handle is directed upward in a substantially normal direction to said one surface, substantially centered on said base, and wherein said catch projects in a direction substantially normal to the principal direction of said handle.

19. A door or panel retention device in accordance with claim 18 which is substantially symmetrical about its long axis extending through the center of said handle, wherein said nesting groove comprises an annular groove coaxial with said handle, and said catch comprises an annular projection coaxial with said handle.

20. A door or panel retention device for installation in or on a rigid panel for latching said rigid panel to a striker bar mounted on a rigid panel which device comprises a one-piece solid body of elastomeric material having a principal plane which, upon installation, is substantially parallel to the surface of said panel, said door or panel retention device having a latching lip which protrudes outwardly from the edge of said body in a direction both parallel to and normal to said principal plane, said lip cut on an inwardly-directed surface to form a catch which is constructed and arranged to just accommodate the thickness of said striker bar in latching relation, an outwardly directed surface of said latching lip comprising a protuberance for elastically-deformable engagement with said striker bar, at least a portion of the outwardly-directed surface of said protuberance forming in a cross-sectional plane an acute angle within the range 15 degrees to 75 degrees with a plane parallel to said principal plane;

wherein said elastomeric body consists essentially of natural or synthetic rubber or elastoplastic material having a durometer hardness within the range 20–100 on the Shore A scale, and 0–100 on the Shore D Scale, an ultimate tensile strength of at least about 300 pounds per square inch (21.9 $Kg/cm^2$), a tear strength of at least about 35 pounds per linear inch (6.24 Kg/cm.), an ultimate elongation of at least about 125%, and a compressibility of at least about 10 percent.

21. A door or panel retention device in accordance with claim 20 having a durometer hardness on the Shore A Scale within the range 20–90 and ultimate tensile strength within the range 550 to 2200 pounds per square inch (3.65 to 146.14 $Kg/cm^2$), and a tear strength within the range 75 to 300 pounds per linear inch (0.89 and 53.57 Kg/cm.).

22. A door or panel retention device in accordance with claim 20 wherein said body portion is a longitudinally extending strip, wherein said lip cut on an inwardly-directed surface to form a catch protrudes outwardly from one edge of said strip.

23. A door or panel retention device in accordance with claim 22 wherein an elongated slot constructed to accommodate the thickness of said panel extends along at least one edge of said strip for substantially the length of said strip.

24. A door or panel retention device in accordance with claim 20 which includes means for securing the installation of said body in or on said rigid panel comprising an elongated slot in the peripheral edge of said one-piece body which is constructed to just accommodate the thickness of said rigid panel.

25. A door or panel retention device in accordance with claim 24 wherein said one-piece body is in the form of an "0" in said principal plane, and wherein said elongated slot is interposed continuously around the peripheral edge of said "0", and wherein said lip cut on an inwardly-directed surface to form said catch depends and protrudes outwardly from at least one edge of said "0".

26. A door or panel retention device in accordance with claim 25 wherein one major surface of said "0" is open and the opposite major surface thereof is closed.

27. A door or panel retention device in accordance with claim 25 wherein said "0" is closed, and wherein a handle is disposed in substantially central relation to said principal plane.

28. A door or panel retention device in accordance with claim 24 wherein said body is in the form of a "C" in said principal plane, wherein said elongated slot is interposed around the peripheral edge of said "C", and wherein said lip cut on an inwardly-directed surface to form said catch depends and protrudes outwardly from the portion of the "C" opposite the opening thereof.

29. A door or panel retention device in accordance with claim 24 wherein said one-piece body is in the form of a rectangle, wherein said elongated slot is interposed around the peripheral edge of said rectangle, and wherein said lip cut on an inwardly-directed surface to form a catch depends and protrudes outwardly from at least one edge of said rectangle.

30. A door or panel retention device in accordance with claim 29 wherein said rectangle comprises a square, and a plurality of lips, each cut on an inwardly directed surface to form a catch, depend and protrude outwardly from a plurality of edges of said square.

31. A door or panel retention device in accordance with claim 29 wherein the one-piece body of said rectangle is open at the center.

32. A door or panel retention device in accordance with claim 24 wherein said one-piece body comprises a polygon having a plurality of sides, and wherein said elongated slot is interposed around the peripheral edge of said polygon, and wherein said lip cut on an inwardly-directed surface to form a catch depends and protrudes outwardly from at least one edge of said polygon.

33. A door or panel retention device in accordance with claim 32 wherein the one-piece body of said polygon is open at the center.

34. A door or panel retention device in accordance with claim 32 wherein the one-piece body of said polygon is closed on at least one major surface.

35. A door or panel retention combination for installation on or adjacent the edges of a first door or panel and a second door or panel for alternatively maintaining said edges in spaced-apart open position or in intimately latched abutting position, which combination comprises:

a striker bar or surface at or near the edge of said first door or panel;

a one-piece body of elastomeric material;

means for installing and rigidly fastening said one-piece body at or near the edge of said second door or panel;

said elastomeric material consisting essentially of natural or synthetic rubber or elastoplastic material having durometer hardness within the range 20–100 on the Shore A Scale and 0–100 on the Shore D Scale, an ultimate tensile strength of at least about 300 pounds per square inch (21.9 $Kg/cm^2$), a percentage of elongation of at least about 125 percent, a tear strength of at least about 35 pounds per linear inch (6.24 K/g cm.), and a compressibility of at least about 10 percent;

said one-piece body comprising a latch having a protuberance which projects outwardly adjacent the edge of said second door or panel in a direction normal to the edge of said second door or panel, said outwardly-directed protuberance being constructed to engage in elastically-deformable relation with transversely-disposed surface of said striker bar or surface when said door or panel retention device is being closed with reference to said striker bar or surface, and to disengage in elastically-deformable relation from said striker bar or surface when said latch is opened.

36. A door or panel retention combination in accordance with claim 35 wherein said one-piece body of elastomer material includes a handle having a base integrally formed on one surface thereof, whereas said protuberance projects outwardly adjacent from the edge of said second door or panel in transverse direction to said handle;

an opening cut near the edge of said second door or panel;

a nesting groove cut into and surrounding an outer surface of said one-piece body of elastomer, being disposed in a plane substantially parallel to said base, the edge of said opening being seated in said nesting groove.

37. The combination in accordance with claim 35 wherein said protuberance is in the form of a semi-spherical bulb or button and said striker bar or surface includes on its outer surface a dimple constructed to accommodate said bulb or button in elastically-deformable relation.

38. A door or panel retention combination in accordance with claim 35 wherein said elastomeric material has a durometer hardness on the Shore A Scale within the range of 20 to 90, an ultimate tensile strength within the range of 20 to 90, an ultimate tensile strength within the range 550 to 2000 pounds per square inch (3.65 to 146.14 $Kg/cm^2$), and a tear strength within the range 75 to 300 pounds per linear inch (0.89 and 53.57 Kg/cm.).

39. A retention device constructed and arranged for installation in or on a rigid panel for latching said panel to a striker bar or surface, which device comprises a one-pice body of elastomer material, said one-piece body having a base comprising means for rigidly fastening said body to said panel, said last named means comprising an elongated slot in the peripheral edge of said one-piece body which is constructed to just accommodate the thickness of said rigid panel;

one-piece body comprising a latch having at least one protuberance which is constructed and arranged when said base is installed in said panel to project outwardly adjacent the edge of said panel in a direction normal to the edge of said panel, said outwardly-directed protuberance being constructed to engage in elastically-deformable relation with a transversely-disposed surface of said striker bar or surface when said device is being closed with reference to said striker bar or surface, and to disengage in elastically-deformable relation from said striker bar or surface when said retainer device is opened.

40. A door or panel retention device in accordance with claim 39 wherein said elastomeric material has a durometer hardness on the Shore A Scale within the range of 20 to 90, an ultimate tensile strength within the range 550 to 2000 pounds per square inch (3.65 to 146.14 $Kg/cm^2$), and a tear strength within the range 75 to 300 pounds per linear inch (0.89 and 53.57 Kg/cm.).

41. A door or panel retention combination comprising elements for installation on or adjacent the edges of a first door or rigid panel and a second door or rigid panel for alternatively maintaining said edges in spaced-apart open position or in elastically engaged abutting position, which combination comprises:

a striker bar or surface at or near the edge of said first door or rigid panel;

a one-piece solid body installed at or near the edge of said second door or rigid panel wherein either said striker bar or surface of said one-piece body consists essentially of elastomeric material;

said one-piece body characterized by a principal plane, which upon installation, is substantially parallel to the principal plane of the surface of said second door or rigid panel, said one-piece body having at least one lip which protrudes outwardly adjacent the edge of said one-piece body in a direction both parallel to and normal to said principal plane, said lip cut on an inwardly-directed surface to form a catch which just accommodates the thickness of said striker bar or surface, the outwardly-directed surface of said lip comrpising a protuberance for elastically-deformable engagement with said striker bar or surface, at least a portion of the surface of said protubrance forming in cross-sectional plane a positive angle within the range 15 degrees to 75 degrees with a plane parallel to said principal plane;

means for securing the installation of said body, or alternatively said striker bar, whichever consists essentially of elastomeric material, comprising an elongated slot in the peripheral edge of said one-piece body or said striker bar, which slot just accommodates the thickness of said first or second rigid panel on which said body or said striker bar is installed.

42. A door or panel retention combination for installatin on or adjacent the edges of a first door or rigid panel and a second door or rigid panel for alternatively maintaining said edges in spaced-apart open position or in elastically engaged abutting position, which combination comprises:

a striker bar or surface at or near the edge of said first door or rigid panel;

a one-piece body, wherein either said striker bar or surface or said one-piece body is of elastomeric material;

measn for installing and rigidly fastening said one-piece body at or near the edge of said second door or rigid panel;

said elastomeric material consisting essentially of natural or synthetic rubber or elastoplastic material having durometer hardness within the range 20–100 on the Shore A Scale and 0–100 on the Shore D Scale, an ultimate tensile strength of at least about 300 pounds per square inch (21.9 $Kg/cm^2$), a percentage of elongation of at least about 125 percent, a tear strength of at least about 35 pounds per linear inch (6.24 K/g cm.), and a compressibility of at least about 10 percent;

said one-piece body comprising a latch having a protuberance which projects outwardly adjacent the edge of said second door or rigid panel in a direction normal to the edge of said second door or rigid panel, said outwardly-directed protuberance being constructed to engage in elastically-deformable relation with a transversely-disposed surface of said striker bar or surface when said retainer device is being closed with reference to said striker bar or surface, and to disengage in elastically-deformable relation from said striker bar or surface when said latch is opened.

43. A door or panel retention combination in accordance with claim 42 wherein said one-piece body includes a handle having a base integrally formed on one surface thereof, whereas said protuberance projects outwardly adjacent the edge of said second door or panel in transverse direction to said handle;

an opening cut near the edge of said second door or panel;

a nesting groove cut into and surrounding an outer surface of said one-piece body, being disposed in a plane substantially parallel to said base, the edge of said opening being seated in said nesting groove.

44. The combination in accordance with claim 42 wherein said protuberance is in the form of a semi-spherical bulb or button and said striker bar or surface includes on its outer surface an annular receptacle constructed to accommodate said bulb or button in elastically-deformable relation.

45. A door or panel retention combination in accordance with claim 42 wherein said elastomeric material has a durometer hardness on the Shore A Scale within the range of 20 to 90, an ultimate tensile strength within the range 550 to 2000 pounds per square inch (3.65 to 146.14 $Kg/cm^2$), and a tear strength within the range 75 to 300 pounds per linear inch (0.89 and 53.57 Kg/cm.).

* * * * *

UNITED STATES PATENT AND TRADEMARK OFFICE

CERTIFICATE OF CORRECTION

PATENT NO. : 4,917,413

DATED : April 17, 1990

INVENTOR(S) : Donald M. Jason; James A. Jason

It is certified that error appears in the above-identified patent and that said Letters Patent is hereby corrected as shown below:

Title sheet, column 1 [73] "Asburg" should read --Asbury--.

Signed and Sealed this

Eleventh Day of June, 1991

*Attest:*

HARRY F. MANBECK, JR.

*Attesting Officer*

*Commissioner of Patents and Trademarks*